United States Patent [19]

Simeth

[11] Patent Number: 4,632,029

[45] Date of Patent: Dec. 30, 1986

[54] INKING MECHANISM FOR LETTERPRESS AND OFFSET PRINTING MACHINES

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 628,257

[22] Filed: Jul. 6, 1984

[30] Foreign Application Priority Data

Jul. 7, 1983 [DE] Fed. Rep. of Germany ..... 3324448

[51] Int. Cl.[4] ..... B41F 31/26; B41F 31/14; B41L 27/16

[52] U.S. Cl. ..... 101/348; 101/DIG. 6

[58] Field of Search ..... 101/348, DIG. 6, 207, 101/208, 209, 210, 206, 349, 148, 352, 217; 29/116 AD; 100/168

[56] References Cited

U.S. PATENT DOCUMENTS 287,383 10/1883 Kendall et al. .

4,467,720 8/1984 Gertsch ..... 101/348

FOREIGN PATENT DOCUMENTS 637289 12/1978 U.S.S.R. ..... 101/348

*Primary Examiner*—J. Reed Fisher

*Attorney, Agent, or Firm*—Leydig, Voit & Mayer, Ltd.

[57] ABSTRACT

The invention relates to an inking mechanism for letterpress and offset printing machines comprising a vibrator having a plurality of discs which are disposed side by side and which are adapted to reciprocate individually and independently of one another between a duct roller and a transfer roller, and the width of each of which corresponds to a specific inking zone. The disc each consist of a middle part and an outer ring with a covering and are disposed side by side without gaps on a stationary carrier tube. Each middle part is mounted movably on the carrier tubes and has a circular outer periphery on which the outer ring is rotatably mounted and a drive for the individual movement of the middle part is provided inside each disc.

3 Claims, 8 Drawing Figures

Fig. 7.
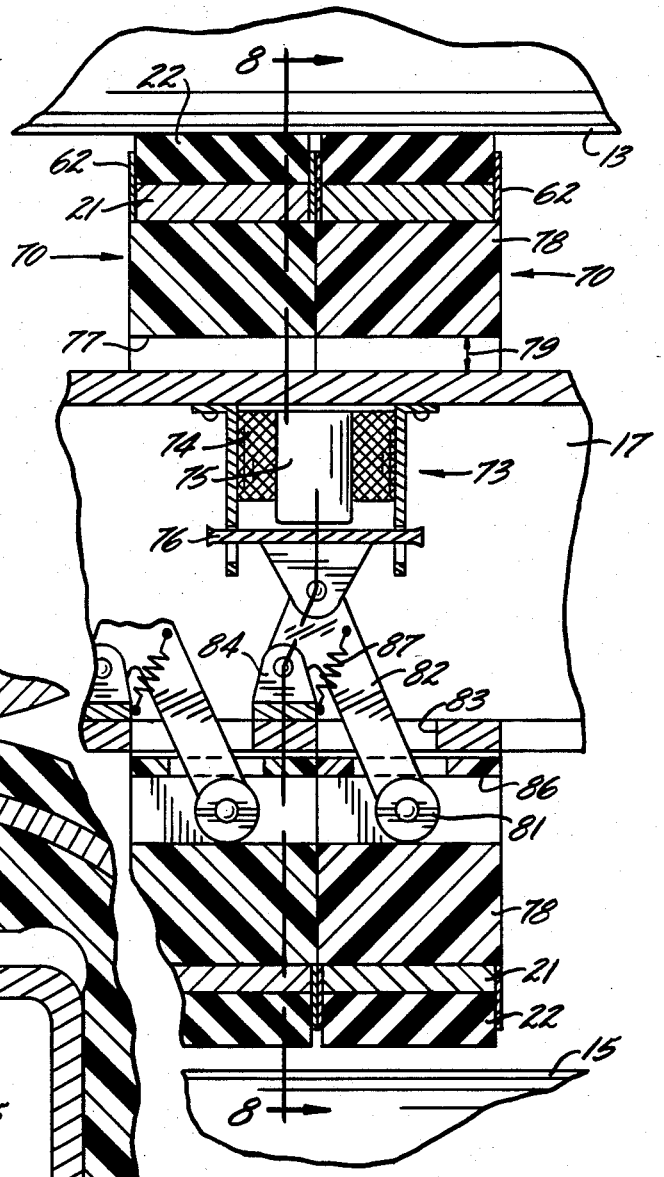
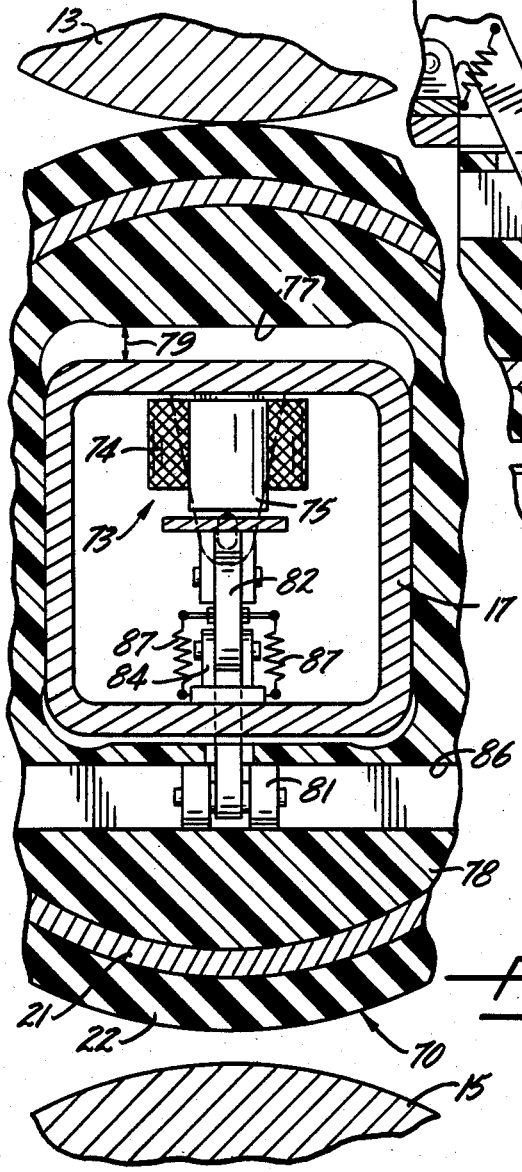
Fig. 8.

INKING MECHANISM FOR LETTERPRESS AND OFFSET PRINTING MACHINES

FIELD OF THE INVENTION

This invention relates generally to an inking mechanism for letter press and offset printing machines, and more particularly concerns a vibrator consisting of a plurality of discs disposed side by side which oscillate individually and independently of one another between the duct roller and a transfer roller of the machine, the width of each disc corresponding to a specific inking zone.

BACKGROUND OF THE INVENTION

In the past, various solutions in the form of split vibrator rollers have been disclosed for good ink transfer for any particular printing run. For example, Swiss Patent Specification No. 169 362 discloses an inking unit for rotary printing machines, comprising a plurality of vibrator rollers disposed side by side on a common shaft and adapted to be individually brought into and out of operation, the length of each roller corresponding to the width of a printing plate. A control system comprising a plurality of cams of different shapes disposed side by side and longitudinally movable on a common shaft is provided for each vibrator roller. The object of this system is to enable the ink delivery for each individual page with respect to the position of the ink strips to be controlled from a central point during operation.

In East German Patent Specification No. 104259 there is disclosed a press whose object is to allow programmed adjustment of predetermined and/or calculated metered quantities of ink and obviate any disturbances in ink delivery during continuous printing by control means according to machine requirements. To this end, a system is provided for dispensing the ink in offset and letterpress printing machines without the use of zone screws and duct blades. To obtain a predetermined uniform inking on the sheet in printing solid areas, the ink film thickness required for each ink and paper combination used is obtained by fine adjustment of a nip between the duct roller and a co-acting roller and/or by differential speed between these two rollers. The zone discs are guided with mounting on only one side.

Referring to West German Patent Specification No. 2 924 635 there is disclosed an ink metering system for letterpress and offset printing machines which is substantially independent of paper constituents and damping water and which enables ink to be supplied according to plate inking requirements. This objective is said to be achieved by an ink metering system consisting of a duct and blade and a duct roller with a vibrator for electronic ink zone remote-control in letterpress and offset printing machines, a plurality of ink vibrator wheels being provided, which oscillate individually and independently of one another and the width of each of which corresponds to a specific ink zone.

All these known systems divide the vibrator roller up into a plurality of transfer rollers arranged side by side in the form of discs, each of which has to be laterally supported for positioning purposes. The results in a large gap between the individual ink transfer rollers if the latter are supported on both sides. However, the disclosed mounting is inadequate to take the forces during the transfer of the ink from the duct roller particularly to a spreader roller. Accordingly, there is always the possibility of lateral deflection during the contact of the vibrator discs and the spreader, because of the narrow mounting plates and since deflection occurs during each contact with the spreader roller there is ultimately the risk of the mounting plate breaking. Unfortunately, no specific details are given of the technical means for controlling the vibrator disc wheels.

SUMMARY OF THE INVENTION

The primary aim of the present invention is to provide a compact and stable zone-wise ink transfer system, which is readily adjustable and can be fitted in the printing machine by the printer without appreciable expense. To this end, there is provided an ink metering system for use with letterpress and offset printing machines including an ink duct with a blade and a duct roller with an ink vibrator, the latter consisting of a plurality of ink vibrator discs, which oscillate individually and independently of one another between the duct roller and a transfer roller and wherein the width of each of the discs corresponds to a specific ink zone. The discs each consist of a middle part and an outer ring with a covering and are arranged side by side contiguously on a stationary carrier tube. The cylindrical outer ring is secured and freely rotatable on the middle part, preferably on a roller bearing and the middle part is mounted movably on a carrier tube with a drive for displacement of the middle part provided inside each disc.

Different types of movement are possible in this connection. The middle part can be mounted eccentrically on the round carrier tube or it may perform a rectilinear movement on a square carrier tube. The drive may be an electrical coil with a magnet core, a stepping motor, or a pneumatic drive.

OBJECTS AND ADVANTAGES OF THE INVENTION

One advantage of the present invention is that the entire disc unit can readily be removed by the printer, without the use of an engineer, since all the transfer discs are disposed compactly on the carrier tube. This means a considerable reduction of the preparation times, since the entire zonal presetting of the duct blade is eliminated. Moreover, all the discs can be washed with the existing washing mechanism, this giving another appreciable reduction of the printing machine preparation time.

Another object is that a special circuit for the activation system may be provided to enable the discs to be synchronized on the carrier tubes. Also, by way of such an electrical activation system it is possible to control the angle of rotation of the individual ink transfer rollers and the time of contact with the duct roller and check the ink strip flow in the ink control unit. This sensing unit is provided in each individual disc and allows extremely small angular fluctuations, e.g. mistakes or differences in the transferred film length, to be compensated. By carrying this sensing operation out over a number of cylinder revolutions, only one evaluation unit is required for "n" discs. Accordingly, the accuracy or sensitivity of the ink metering system is appreciably increased, so that the different ink strips can be specially controlled at widely varying displacement frequencies.

A more specific advantage is obtained if for example, an angular increment pick-up running in synchronism with the plate carrier is coupled to a computer programmed with the inking unit characteristic data. This enables ink fluctuations in a zone to be controllably counteracted. By controlling the starting point of the corresponding ink transfer rollers and regulating their displacement frequency and the change of the ink strip to be conveyed, an ink profile varying zonewise can controllably be produced not only axially but also radially on the printing plate. With the high accuracy of the ink metering system of the invention it is possible to detect the ink temperature by indirect measurement of the temperature by way of the discs. Regulation of the pre-dispensing mechanisms and of the ink transfer roller angle of rotation at the duct roller is derived from these values. This eliminates any production inaccuracies, bearing inaccuracies, wear and temperature influences. This very advantageously means a much cheaper and more robust system and a further reduction in cost lies in the greater tolerance to which the individual parts can be constructed.

A further object is that with the present invention the ink zone divisions can now be made much smaller than previously, since the limitations, which are now conventional in offset printing originating from the flexibility of the duct blade, are essentially eliminated. Moreover, the wear of the discs, like the wear at the duct roller, is almost zero compared with known inking elements, since there is no friction. As stated above, this is a great advantage in respect of the temperature influences of the working process, because the temperature remains substantially constant over longer periods. And since the closely adjacent discs do not form any gaps in the ink transfer, an optimum uniformity over the entire machine width is achieved. This means that spreading or distribution can be minimal, and can in fact even be dispensed with for equalizing the ink in the ink transfer area, since the distribution at the plate is adequate in view of the optimum ink transfer.

Another advantage of the very uniform ink transfer of the present invention is that there is no need to destroy the residual ink running back in the roller train after inking. This means that a short inking unit can be used in the printing machines for specific requirements.

Other objects and advantages of the invention will be apparent upon reference to the following description of the exemplified embodiments with reference to the accompanying drawings wherein:

BRIEF DESCRIPTION OF THE DRAWINGS

FIGS. 7 and 8 are enlarged fragmentary sections showing discs in which the traversing movement is generated by a magnet and lever arrangement

DETAILED DESCRIPTION OF THE INVENTION

Figure 1:
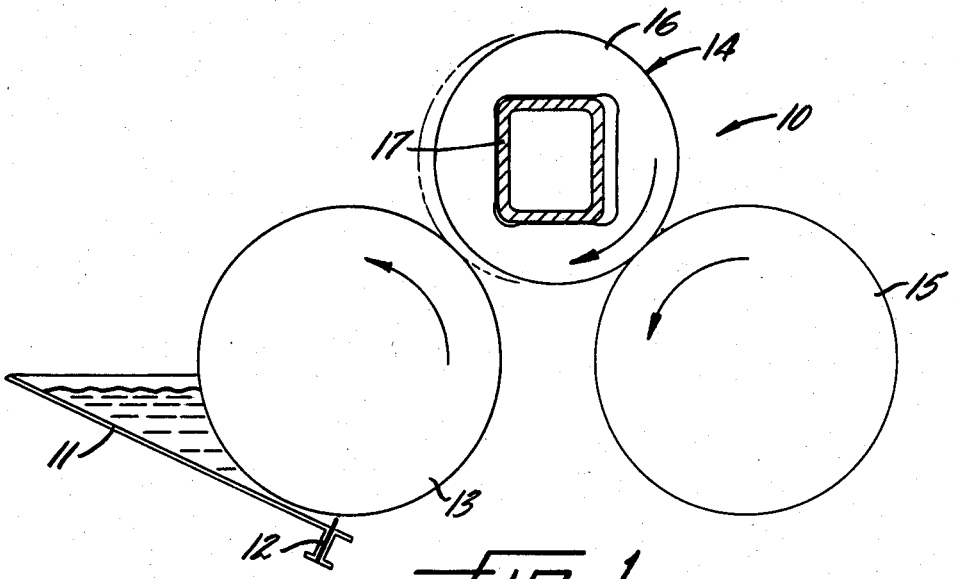
FIG. 1 is a schematic side elevation of the ink metering mechanism of the present invention.
Figure 2:
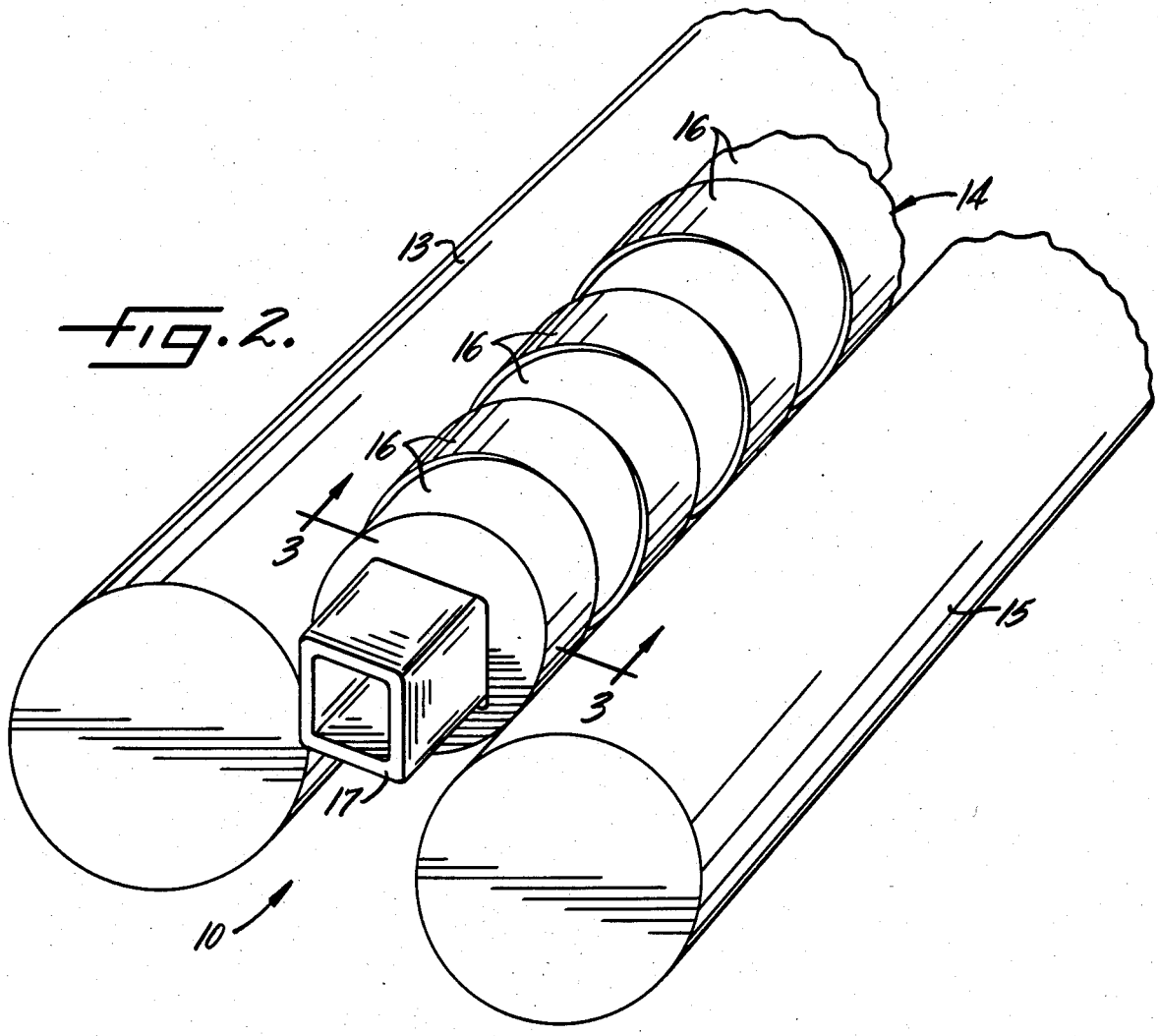
FIG. 2 is a schematic perspective view of the individual zonal discs on a carrier tube between a duct roller and a transfer roller of the mechanism shown in FIG. 1.

Turning now to the drawings, there is shown schematically in FIGS. 1 and 2, the inking mechanism 10 of the present invention. In its general arrangement, the mechanism 10 includes an ink duct 11, a duct blade 12, a duct roller 13 and a vibrator unit 14 which selectively transfers ink from the duct roller 13 to a transfer roller 15. More particularly, the vibrator unit 14 consists of a plurality of discs 16 which are disposed side by side and which are mounted on a carrier tube 17 for movement individually and independently between the duct roller 13 and the transfer roller 15 for zonal ink transfer. The width of each disc 16 corresponds to a specific inking zone and the discs are situated close together and transfer the ink without any gap between them.

It will be understood that the discs 16 may be mounted on the carrier tube 17 in various ways for eccentric or reciprocal movement between the duct roller 13 and transfer roller 15 and various different drive mechanisms may be provided for independently accomplishing and controlling such movements. In the description which follows, the several illustrative embodiments disclosed in the drawings will be described. It is contemplated, however, that all of the discs mounted on a common carrier tube will be identical in construction, drive and operation.

Figure 3:
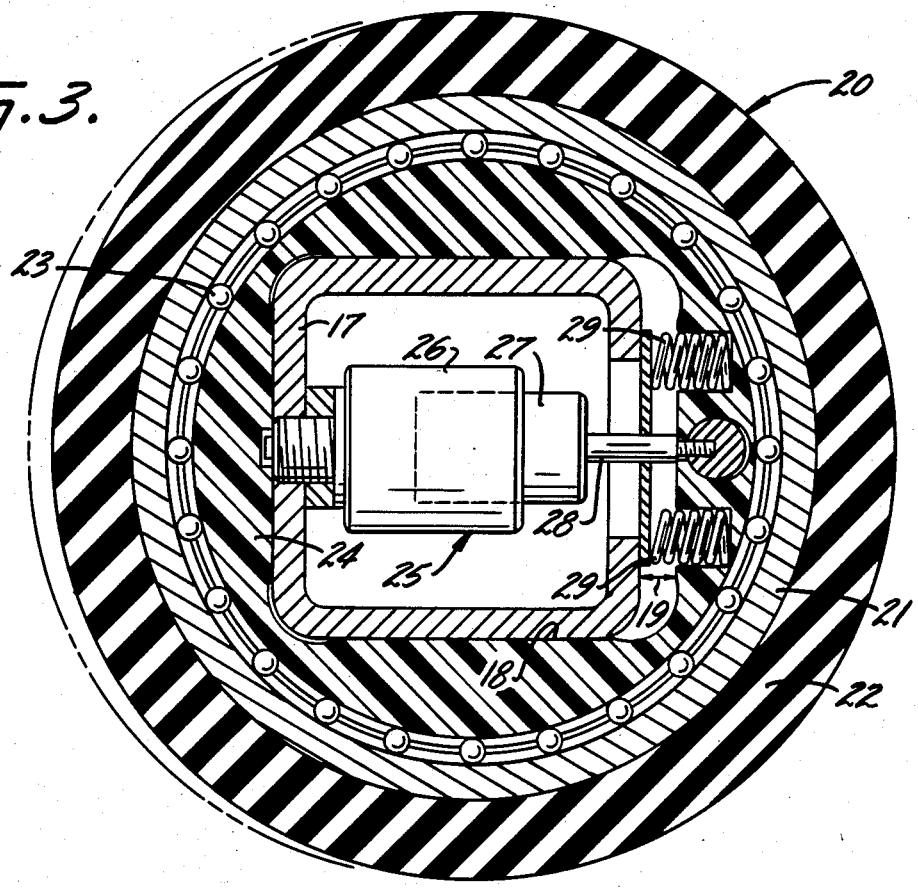
FIG. 3 is an enlarged section taken along line 3—3 in FIG. 1 showing a disc movable on a square carrier tube and a middle part of plastic, the movement being rectilinear by means of an electromagnet.

In the embodiment shown in FIG. 3, which is an enlarged section taken along line 3—3 of FIG. 2, a disc 20 is mounted for rectilinear movement on a square carrier tube 17. The disc 20 comprises a cylindrical outer ring 21 with a covering 22 which receives the ink depending upon the amount of time that it is in contact with the duct roller 13. As shown here the outer ring 21 is supported on a middle part 24 by a race of frictionless bearings 23. Alternatively, the middle part 24 may consist of a self-lubricating material, e.g. Turcite disposed around the carrier tube 17.

Pursuant to the invention, the middle part 24 has a rectangular cut-out 18 which on one side is made larger than the carrier tube 17 by an amount 19 which provides some travel space so the middle part 24 can move by the amount 19 on the carrier tube 17 rectilinearly when a corresponding pulse is applied to the disc 20 by a drive 25. The latter is in this case an electromagnet 26 which transmits the movement via a plunger 27 to a transverse rod 28 which is in turn anchored in the middle part 24. The return movement of the middle part 24 by the amount 19 is via springs 29. In this way, the cover 22 of the outer ring 21 of the disc 20 can be intermittently moved into and out of contact with the duct roller 13 and the transfer roller 15 to selectively control the transfer of ink therebetween. It will be understood that the electrical leads for the electromagnet 26 may be housed within the carrier tube 17 and fed axially to an exit point where they are connected to a suitable control circuit such as a programmable computer to govern the operation of the electromagnet and movement of the disc 20 on the tube 17.

Figure 4:
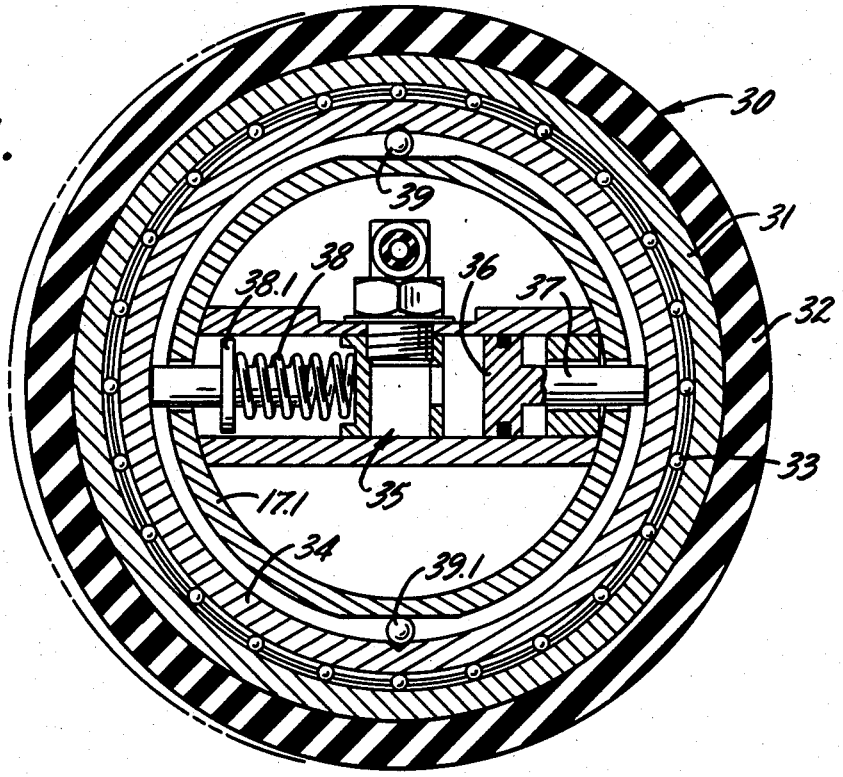
FIG. 4 is a similar section showing a disc pivotable pneumatically with a plunger and return spring about a top suspension point.

In FIG. 4 there is shown a disc 30 disposed on a cylindrical carrier tube 17.1 and adapted to reciprocate with a rocking movement around said tube by means of a drive 35. The disc 30 consists of a covering 32, an outer ring 31 therebeneath disposed on a roller bearing 33 so as to be rotatable with a smooth motion on a middle part 34. The latter is in turn disposed centrally on the carrier tube 17.1 on a guide roller 39. The underside of the carrier tube 17.1 is flattened and a guide roller 39.1 slidingly guides the middle part 34 during the rocking movements. The latter are produced by a pneumatic reciprocating piston 36 which transmits its movements to a plunger 37, the latter acting on the middle part 34 through a bore in the carrier tube 17.1. The return rocking movement is provided by a spring 38 and a plunger 38.1 which is guided just like the reciprocating piston 36 and plunger 37 in the drive 35 of the carrier tube 17.1.

The pneumatic control for the drive 35 is located in the cavity of the carrier tube 17.1. The exhaust air from the pneumatic drive is used as forced ventilation of the cavity in the carrier tube to dissipate any heat evolved. Similar forced ventilation is provided for heat dissipation in the other exemplified embodiments, thus providing a very favorable means of rendering the temperature uniform inside the inking mechanism.

Figure 5:
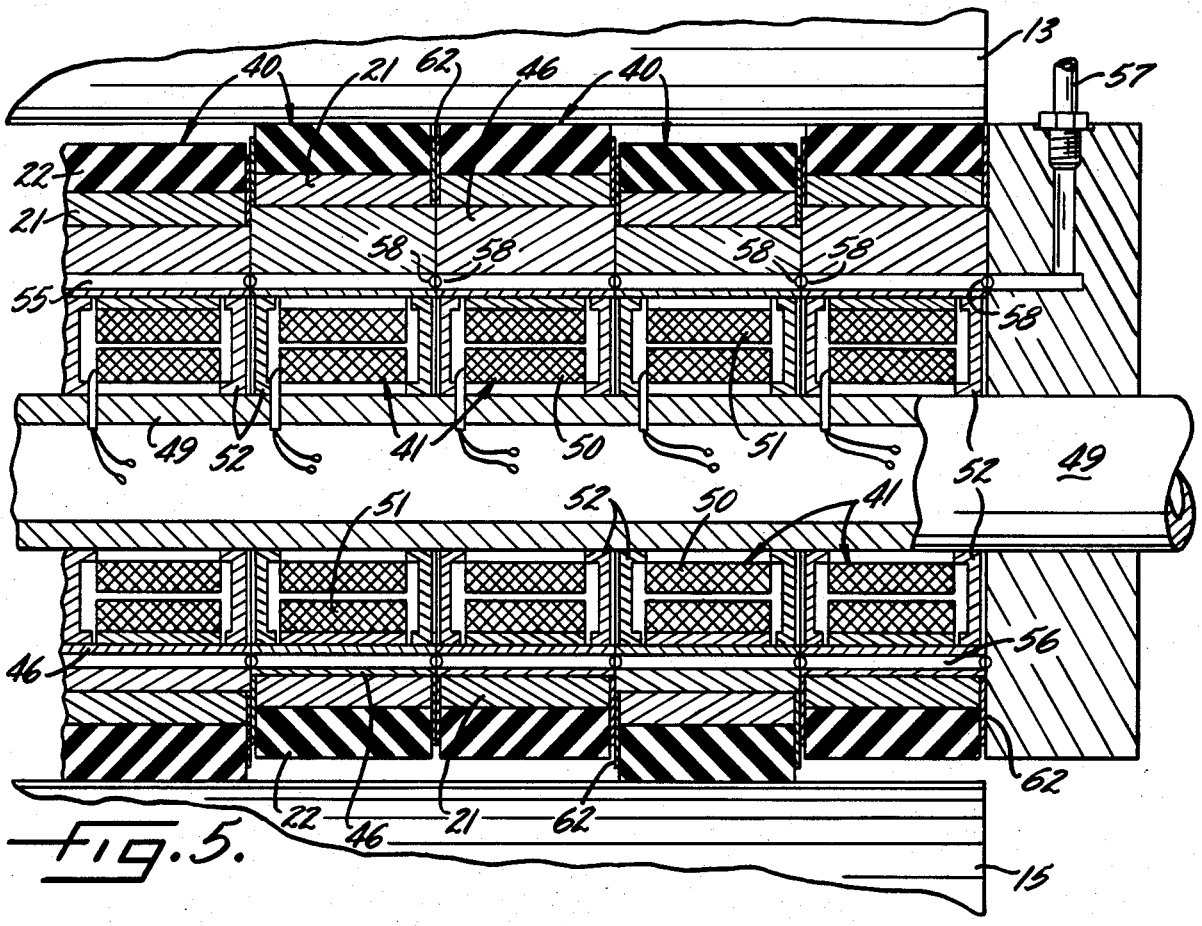
FIG. 5 is a longitudinal section through a number of eccentric discs mounted with a stepping motor on a round carrier tube.

In the embodiment shown in FIG. 5, a plurality of discs 40 are disposed side by side on a carrier tube 49. The discs 40 have different positions depending upon the positions to which they have been turned by a stepping motor drive 41. Like all the other discs, the discs 40 comprise a covering 22 and a cylindrical outer ring 21. The latter runs on an eccentric middle part 46 so that the drive 41 can provide the movements for transferring ink between the duct roller 13 and the transfer roller 15 (see FIGS. 1 and 2). In this case the drive 41 is a stepping motor consisting of an inner rin 50 and an outer ring 51. The inner ring 50 is shrunk on the carrier tube 49 while the outer ring 51 is fixed in the eccentric middle part 46. The discs 40 are fixed on the carrier tube 49 by side mountings 52. The latter also provides a channel for a plurality of lubricating and air ring lines 55, 56 which extend between the individual discs 40 in the middle part 46 and are connected to an external fitting 57. The lines 55, 56 communicate with a circular half recess 58 on each side wall of the middle parts 46 so that the middle parts 46 of the discs 40 can move past each other with only lightly sliding contact on one another.

Figure 6:
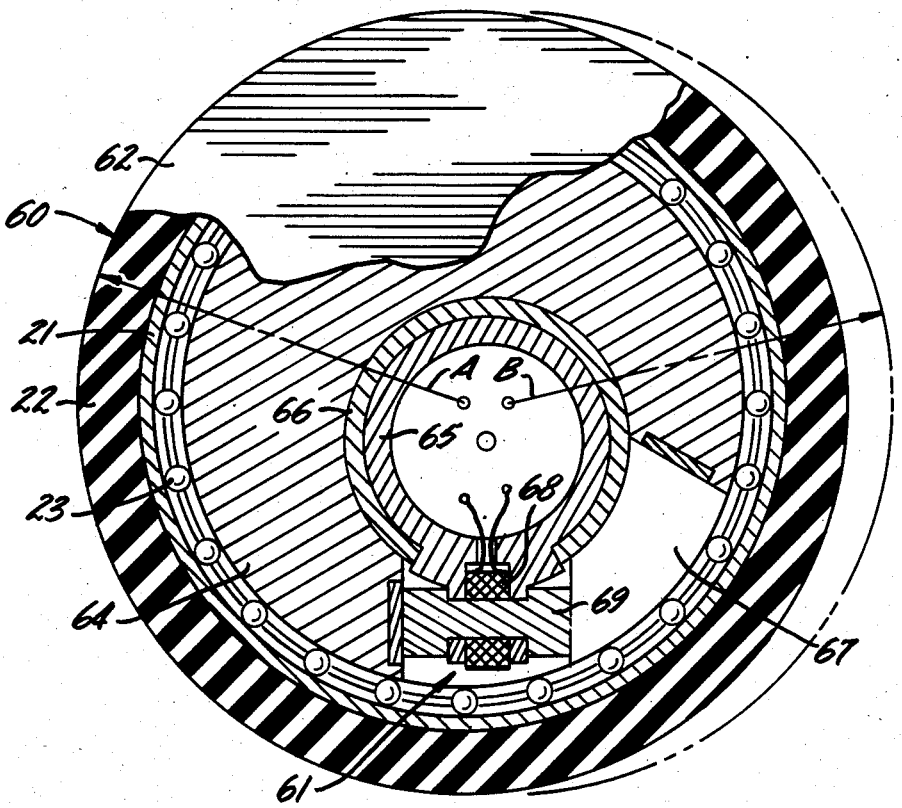
FIG. 6 is a section similar to FIGS. 3 and 4 showing an eccentrically mounted disc pivotally movable on a carrier tube by an electromagnet.

FIG. 6 shows another embodiment of a disc 60 consisting of the covering 22 and the cylindrical outer ring 21 which is rotatably supported on a middle part 64 by means of a roller bearing 23. The middle part 64 is mounted eccentrically on a substantially round carrier tube 65. Between the carrier tube 65 and the eccentric middle part 64 there is disposed a sliding bearing 66. The middle part 64 additionally has a free space 67 containing an electromagnetic drive 61. The latter consists of a coil 68 and a magnet core 69. On one side, the disc 60 has a seal 62 which prevents ink from entering and also promotes free eccentric movement of the discs 60 with respect to one another.

By oppositely energizing the leads of the coil 68 of the electromagnetic drive, the core 69 is caused to selectively attract and repel metal plates at the ends of the free space 67. This, in turn, causes the middle part 64 to rotate eccentrically on the bearing 66 of the carrier tube 65 and produces the displacement of the disc 60 as represented by eccentric radius lines A and B.

Turning now to FIG. 7, there is shown a section through two discs 70 mounted on a square carrier tube 17 in a similar manner to the embodiment of FIGS. 1-3. In FIG. 8, a section taken along line 8—8 in FIG. 7 is shown. The discs 70 again consist of the covering 22 and the cylindrical outer ring 21 which in this case is mounted for sliding rotation on a middle part 78, made of a sliding material, such as Turcite. The middle part 78 has a central opening 77 and performs a rectilinear movement on the carrier tube 17. The amount of travel 79 is in this case the maximum rectilinear movement of the middle parts 78 or the discs 70 on the carriertube 17. The disc movement is produced by an electrical drive 73. In this case the drive 73 is an electromagnet 74 fixed at one end inside the carrier tube 17. It surrounds a metal core 75 to attract a magnetic plate 76. The travel of the magnetic plate 76 is transmitted to a roller 81 via a lever 82 extending through a slot 83 in the carrier tube and articulated about a pivot support 84 on the inside on the carrier tube 17. Roller 81 is guided in a guide 86 of the middle part 78 of the discs 70. Thus the minimum travel of the magnetic plate 76 can be boosted via the lever 82 to the amount of travel shown at 79. Return movement of the roller 81 and lever 82 may be provided by suitable springs 87 interconnecting the lever and the pivot support 84.

From the foregoing, it will be seen that various vibrator disc arrangements are provided with the discs mounted side by side on a carrier tube 17 for independent individual movement for selective engagement between a duct roller 13 and a transfer roller 15 of a printing press. The vibrator discs are each provided with an internal drive mechanism which may be electromagnetic; pneumatic or electromechanical in nature to cause either rectilinear or eccentric rotational movement of the discs 14. Suitable controls are provided for the drive mechanisms and the discs may be lubricated and ventilated by channels formed in the middle parts of the discs. A seal 62 on one side of the discs allows the close side by side mounting without gaps and without leakage of ink between the discs.

I claim as my invention:

1. An inking mechanism for letterpress and offset printing machines comprising a vibrator consisting of a square, stationary carrier tube and a plurality of discs which are disposed side-by-side without gaps on said carrier tube and the width of each disc corresponds to a specific inking zone, each disc consisting of a middle part mounted movably on said carrier tube between extreme positions eccentric to the center of said carrier tube and having a circular outer periphery, and an outer ring rotatably mounted on said circular outer periphery of said middle part and having a covering, means for sealing the sides of adjacent discs, and electromagnet means disposed within said carrier tube for each disc, said electromagnet means having a plunger secured to a transverse rod disposed inside said middle part and guided rectilinearly in said carrier tube for driving the middle part on the stationary carrier tube between said extreme eccentric positions whereby each said disc is movable individually and independently of the other discs between a duct roller and a transfer roller according to the motion of the middle part on the stationary carrier tube.

2. An inking mechanism according to claim 1, further characterized in that interconnected lubrication or air ventilating lines are disposed between the middle parts and are adapted to be connected to a side mounting of the discs fixed on the carrier tube.

3. An inking mechanism according to claim 1, further characterized in that the middle part is formed from a sliding bearing material and a rectangular cut-out of the middle part is cut out in the direction of rectilinear movement of the disc so as to be larger than the outside dimensions of the carrier tube by an amount corresponding to the desired travel of the middle part.

* * * * *